US007002538B2

(12) United States Patent
Lee

(10) Patent No.: US 7,002,538 B2
(45) Date of Patent: Feb. 21, 2006

(54) LIQUID CRYSTAL DISPLAY, DRIVING METHOD THEREOF AND FRAME MEMORY

(75) Inventor: Baek-Woon Lee, Yongin-si (KR)

(73) Assignee: Samsung Electronics Co., Ltd., (KR)

( * ) Notice: Subject to any disclaimer, the term of this patent is extended or adjusted under 35 U.S.C. 154(b) by 277 days.

(21) Appl. No.: 10/364,005

(22) Filed: Feb. 10, 2003

(65) Prior Publication Data

US 2003/0151579 A1 Aug. 14, 2003

(30) Foreign Application Priority Data

Feb. 8, 2002 (KR) ..... 2002-7366

(51) Int. Cl.
*G09G 3/36* (2006.01)

(52) U.S. Cl. ..... 345/87; 345/89

(58) Field of Classification Search ..... 345/87, 345/89; 365/189.01
See application file for complete search history.

(56) References Cited

U.S. PATENT DOCUMENTS 5,572,655 A * 11/1996 Tuljapurkar et al. ..... 345/519
5,590,078 A * 12/1996 Chatter ..... 365/189.01
5,905,484 A * 5/1999 Verhulst ..... 345/98
6,825,824 B1 * 11/2004 Lee ..... 345/89

FOREIGN PATENT DOCUMENTS

KR 2001-0077568 8/2001

OTHER PUBLICATIONS

Amitai, Z.; Wyland, D.C.; "Burst Mode Memories Improve Cache Design", Electro International, 1991, Apr. 16-18, 1991; pp. 279-282.*

* cited by examiner

*Primary Examiner*—Amare Mengistu
*Assistant Examiner*—Steven Holton
(74) *Attorney, Agent, or Firm*—Cantor Colburn LLP

(57) ABSTRACT

A liquid crystal display according to the present invention includes a gray signal modifier connected with a frame memory outputting and storing data by a burst mode. The gray signal modifier receives a gray signal of current frame from a data gray signal source and stores it in the frame memory by the burst mode, and reads a gray signal of previous frame stored in the frame memory to generate and output a modified gray signal in consideration of a gray signal of current frame and a gray signal of previous frame. Data pins and instruction pins of the frame memory share buses interfacing with the gray signal modifier.

13 Claims, 5 Drawing Sheets

POWER UP
CS
Command
DQM
Data
NOP
PRE
AR
AR
MRS
Hi-Z
Hi-Z
Hi-Z

Fig. 5B

BURST-READING

| | | | | | | | | | | | | | | | | |
|---|---|---|---|---|---|---|---|---|---|---|---|---|---|---|---|---|
| CS | | | | | | | | | | | | | | | | |
| Command | | | PRE0 | | | RA0 | | | RD0 | | | | | | | |
| DQM | | | | | | | | | | | | | | | | |
| Data | LT=2 | Hi-Z | Hi-Z | Hi-Z | Hi-Z | Hi-Z | Hi-Z | Hi-Z | Hi-Z | Hi-Z | Hi-Z | Q1 | Q2 | Q3 | Q4 | Q5 |
| | LT=3 | Hi-Z | Hi-Z | Hi-Z | Hi-Z | Hi-Z | Hi-Z | Hi-Z | Hi-Z | Hi-Z | Hi-Z | Q0 | Q1 | Q2 | Q3 | Q4 |

BURST-READING OF NEXT BANK

| | | | | | | | | | | | | | | | | |
|---|---|---|---|---|---|---|---|---|---|---|---|---|---|---|---|---|
| CS | | | | | | | | | | | | | | | | |
| Command | | | | | PRE1 | | | RA1 | | | RD1 | | | | | |
| DQM | | | | | | | | | | | | | | | | |
| Data | LT=2 | Q254 | Q255 | Q0 | Hi-Z | Hi-Z | Hi-Z | Hi-Z | Hi-Z | Hi-Z | Hi-Z | Hi-Z | Hi-Z | Q1 | Q2 | Q3 |
| | LT=3 | Q253 | Q254 | Q255 | Hi-Z | Hi-Z | Hi-Z | Hi-Z | Hi-Z | Hi-Z | Hi-Z | Hi-Z | Hi-Z | Q1 | Q2 | Q3 |

END OF LINE

| | | | | | | | | | | | | | | | | |
|---|---|---|---|---|---|---|---|---|---|---|---|---|---|---|---|---|
| CS | | | | | | | | | | | | | | | | |
| Command | | | | | | | | | | | | | | | | |
| DQM | | | | | | | | | | | | | | | | |
| Data | LT=2 | Q254 | Q255 | Q0 | Hi-Z | Hi-Z | Hi-Z | Hi-Z | Hi-Z | Hi-Z | Hi-Z | Hi-Z | Hi-Z | Hi-Z | Hi-Z | Hi-Z |
| | LT=3 | Q253 | Q254 | Q255 | Hi-Z | Hi-Z | Hi-Z | Hi-Z | Hi-Z | Hi-Z | Hi-Z | Hi-Z | Hi-Z | Hi-Z | Hi-Z | Hi-Z |

Fig. 5C

BURST-WRITING

| | | | | | | | | | | | | | | | |
|---|---|---|---|---|---|---|---|---|---|---|---|---|---|---|---|
| CS | | | | | | | | | | | | | | | |
| Command | | PRE0 | | | RA0 | | | WR0 | | | | | | | |
| DQM | | | | | | | | | | | | | | | |
| Data | Hi-Z | Hi-Z | Hi-Z | Hi-Z | Hi-Z | Hi-Z | Hi-Z | Hi-Z | D1 | D2 | D3 | D4 | D5 | D6 | D7 |

BURST-WRITING OF NEXT BANK

| | | | | | | | | | | | | | | | |
|---|---|---|---|---|---|---|---|---|---|---|---|---|---|---|---|
| CS | | | | | | | | | | | | | | | |
| Command | | | | PRE1 | | | RA1 | | | WR1 | | | | | |
| DQM | | | | | | | | | | | | | | | |
| Data | D254 | D255 | D0 | Hi-Z | Hi-Z | Hi-Z | Hi-Z | Hi-Z | Hi-Z | Hi-Z | D1 | D2 | D3 | D4 | D5 |

END OF LINE

| | | | | | | | | | | | | | | | |
|---|---|---|---|---|---|---|---|---|---|---|---|---|---|---|---|
| CS | | | | | | | | | | | | | | | |
| Command | | | | | | | | | | | | | | | |
| DQM | | | | | | | | | | | | | | | |
| Data | D254 | D255 | D0 | Hi-Z | Hi-Z | Hi-Z | Hi-Z | Hi-Z | Hi-Z | Hi-Z | Hi-Z | Hi-Z | Hi-Z | Hi-Z | Hi-Z |

LIQUID CRYSTAL DISPLAY, DRIVING METHOD THEREOF AND FRAME MEMORY

BACKGROUND OF THE INVENTION (a) Field of the Invention

The present invention relates to a liquid crystal display, a driving method thereof and a frame memory for use in the liquid crystal display.

(b) Description of the Related Art

In recent years, lightness and slimness of personal computers and television sets requires light-weighted and thin displays. According to such a requirement, flat panel displays ("FPDs") such as liquid crystal displays ("LCDs") has been developed in replacement of cathode ray tubes ("CRTs").

The LCD, which includes two panels and a liquid crystal layer with dielectric anisotropy disposed therebetween, displays desired images by applying electric field to the liquid crystal layer and adjusting the strength of the electric field to control the amount of light passing through the panels. Such LCDs are representatives of FPDs, and among the LCDs, a TFT LCD using thin film transistor ("TFTs") as switching elements is mainly employed.

In addition, since the TFT LCD is used not only as a display of computer but also as a display of television, implementation of moving pictures is increasingly required. The human recognizes as moving pictures subsequent pictures displayed at high speed equal to or larger than 24 frames per second. This is due to an afterimage effect that human eyes remember recognized pictures for 0.04 seconds.

An impulsive luminescent type display such as a CRT has a blank interval between previous and next frames, which is compensated by the afterimage effect. Therefore, the larger difference in brightness between before and after frames cannot prevent the implementation of natural moving pictures due to the blank interval. However, a conventional TFT LCD has a drawback that it is not easy to implement moving pictures because of slow response time. To improve this problem of response time, a conventional art has employed a TFT LCD in an optically compensated band ("OCB") mode or using a ferroelectric liquid crystal ("FLC") material.

However, an OCB mode LCD or an FLCD has a panel structure different from a normal TFT LCD. The applicant solved the above problem by adding a gray signal modifier capable of generating modified data voltages without changing a panel structure of the TFT LCD, in the Korean Patent Laid-Open Number 2001-0077568 entitled "A Liquid Crystal Display and Driving Method Thereof" (filed on Feb. 3, 2000 and laid-open on Aug. 20, 2001).

A frame memory for the gray signal modifier for storing and outputting the gray signal may be embedded in the gray signal modifier, however, it is preferable in view of price to be implemented as an external memory shown in FIG. 3.

In this case, the gray signal modifier needs pins for interfacing the external frame memory. However, the size of die of the gray signal modifier is increased proportional to a square of the total number of the pins, and this in turn increases production cost.

SUMMARY OF THE INVENTION

To solve the problems, the portion a gray signal modifier interfaces with a frame memory is decreased.

In the present invention some pins of the frame memory share buses interfacing with the gray signal modifier.

According to the first feature of the present invention, a liquid crystal display includes a liquid crystal display panel, a gate driver, a data driver and a gray signal modifier. The liquid crystal display panel includes a plurality of gate lines for transmitting scan signals, a plurality of data lines for transmitting data voltages and insulated with and intersecting the gate lines, and a plurality of pixels formed on areas defined by the gate lines and the data lines, each of which has a switching element connected to the gate line and the data line and disposed in a matrix form.

The gray signal modifier receives a gray signal from a data gray signal source and generates and outputs a modified gray signal considering a gray signal of current frame and a gray signal of previous frame, and a gate driver supplies the scan signal to the gate lines sequentially, and the data driver converts the modified gray signal outputted from the data gray signal source into a corresponding data voltage and supplies it to the data line.

Here, the gray signal modifier comprises a frame memory storing the gray signal of the current frame from the data gray signal source by a burst mode that processes a specific amount of data by one instruction and outputting the gray signal of the previous frame by the burst mode.

In addition, it is preferable that the gray signal modifier includes a controller controlling reading and writing the gray signal of the frame memory, and a gray signal converter generating and outputting the modified gray signal depending on the gray signal of the current frame and the gray signal of the previous frame. And the gray signal modifier may include a cache memory temporarily storing the gray signal of the current frame inputted sequentially and transmitting it to the frame memory.

In this case, it is preferable that the frame memory is formed on the exterior of the gray signal modifier to interface with the gray signal modifier.

To interface with the gray signal modifier, the frame memory includes a plurality of data pins, a plurality of instruction pins, a data masking pin and a chip selecting pin. The instruction pins share the buses with the data pins and receiving instructions needed to operate the frame memory, through each of which data are inputted/outputted.

The data masking pin is used to mask the data pins when no data input/output, and the chip selecting pin is used to select the buses as the data pins or the instruction pins.

In this case, it is preferable that the buses are used in the instruction pins when the data masking pins and the chip selecting pins are in the active state, and the buses are used in the data pins when the data masking pins and the chip selecting pins are in the inactive state.

Here, on burst-reading data from the frame memory, the buses are used in the instruction pins, so that banks of the frame memory are precharged and addresses of row storing data and column of first data to be read are assigned, and the buses are used in the data pins, so that data of the assigned row are burst-read from the assigned column.

In addition, on burst-writing data in the frame memory, the buses are used in the instruction pins, so that banks of the frame memory are precharged and addresses of row writing data and column of first data to be written are assigned, and the buses are used in the data pins, so that data of the assigned row are burst-written from the assigned column.

According to the second feature of the present invention, a method of driving the liquid crystal display according to the first feature of the present invention is provided. The method includes either burst-reading a gray signal of a previous frame or burst-writing a gray signal of a current frame. The burst-reading or burst writing is performed using the buses as the data pins or the instruction pins by changing the state of the data masking pins and the chip selecting pins.

Here, the burst-reading includes precharging banks of the frame memory by selecting the buses as the instruction pins, assigning a row storing a gray signal to be read, assigning an address of first column to be read in the assigned row, and changing the buses into the data pins to read a gray signal stored in the assigned column by the burst mode from the assigned column one by one.

In addition, the burst writing includes precharging banks of the frame memory by selecting the buses as the instruction pins, assigning rows storing a gray signal to be read, assigning an address of first column to be read in the assigned row, and changing the buses into the data pins to write a gray signal in the assigned row by the burst mode from the assigned one by one.

In this case, on precharging the banks, it is possible to precharge only banks having the assigned row out of the banks of the frame memory, or to precharge all the banks of the frame memory simultaneously. Or, on assigning the address of first row it is possible to provide an auto-precharge instruction so that next bank is precharged within the frame memory by itself.

In addition, before burst-writing, it is possible to write the gray signal in the frame memory after temporarily storing it in an external cache memory.

BRIEF DESCRIPTION OF THE DRAWINGS

FIG. 5B is a sequence drawing illustrating burst reading of a frame memory, and FIG. 5*c* is a sequence drawing illustrating burst writing of a frame memory.

DETAILED DESCRIPTION OF THE PREFERRED EMBODIMENTS

The present invention now will be described more fully hereinafter with reference to the accompanying drawings, in which preferred embodiments of the invention are shown. The present invention may, however, be embodied in many different forms and should not be construed as limited to the embodiments set forth herein.

First, an LCD and a gray signal modifier according to an embodiment of the present invention will be described with reference to FIG. 1 to FIG. 3.

Figure 1:
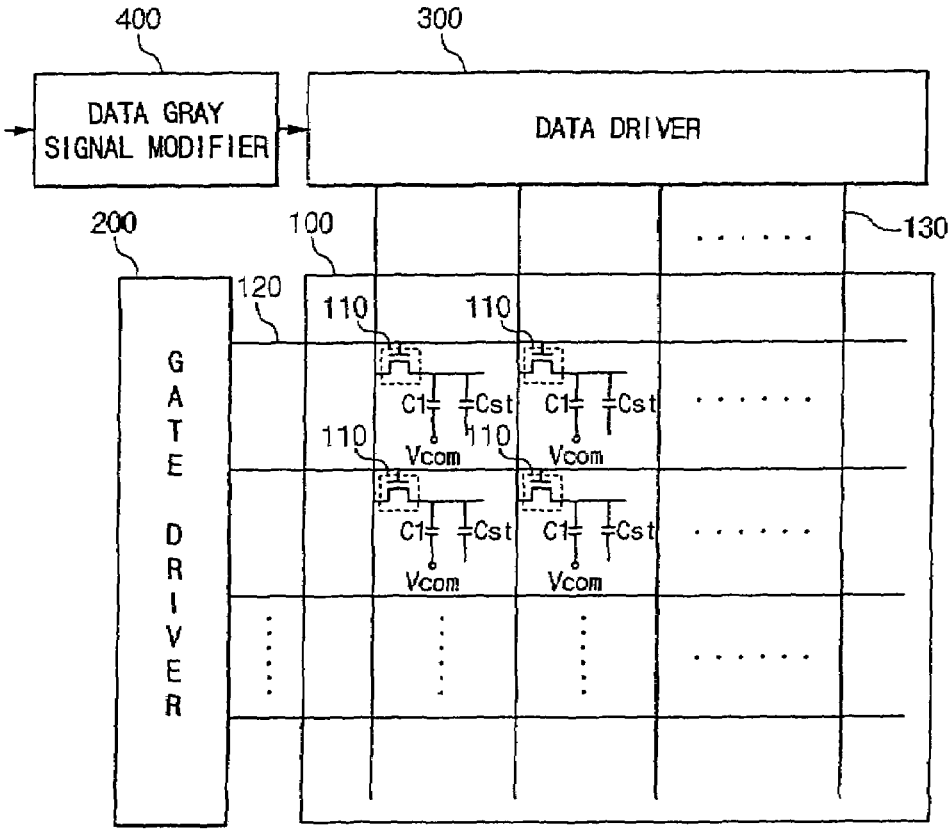
FIG. 1 illustrates a liquid crystal display according to an embodiment of the present invention.
Figure 2:
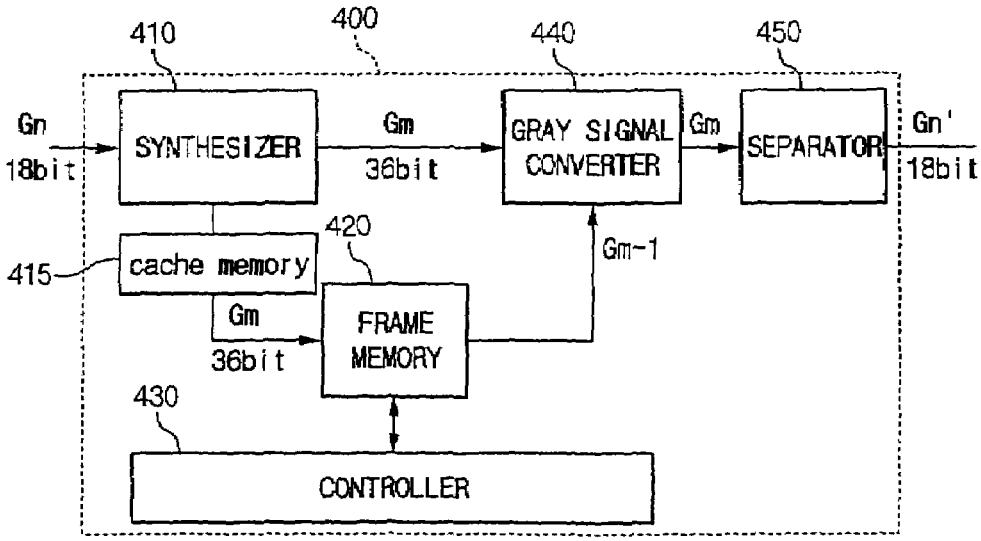
FIG. 2 is a block diagram illustrating a gray signal modifier according to an embodiment of the present invention.
Figure 3:
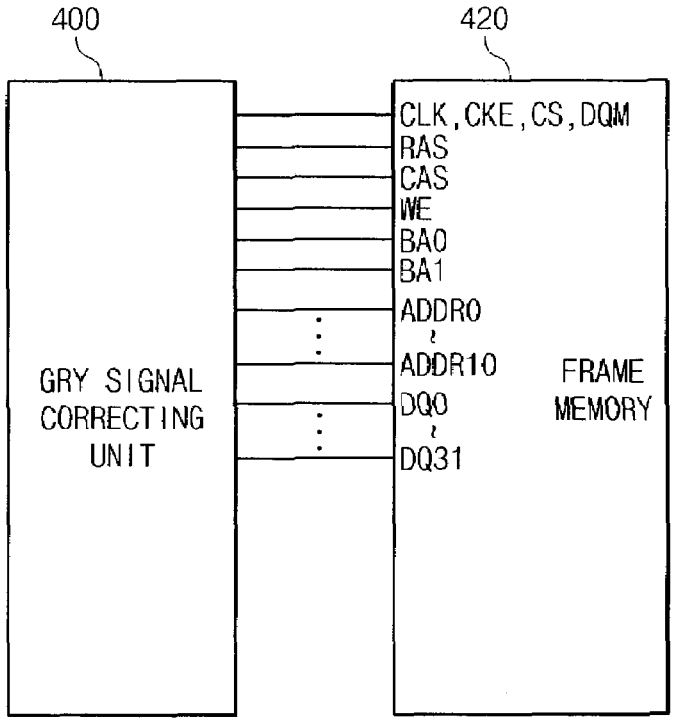
FIG. 3 is a block diagram illustrating an implementation of a frame memory as an external memory.

FIG. 1 illustrates an LCD according to an embodiment of the present invention, FIG. 2 is a block diagram illustrating a gray signal modifier according to an embodiment of the present invention, and FIG. 3 is a block diagram illustrating an implementation of a frame memory as an external memory.

As shown in FIG. 1, an LCD according to an embodiment of the present invention includes a liquid crystal panel 100, a gate driver 200, a data driver 300 and a data gray signal modifier 400.

A plurality of gate lines 120 for transmitting a gate on voltage and a plurality of data lines 130 for transmitting data voltages are formed on the liquid crystal panel 100. Two neighboring gate lines 120 define a pixel area together with two neighboring data lines 130, and a TFT 110 is formed on each pixel area. A gate electrode connected to the gate line 120 and a source electrode and a drain electrode connected to the data line 130 form three terminals of the TFT 110, and a pixel capacitor C1 and a storage capacitor Cst are connected to the drain electrode of the TFT 110.

The gate driver 200 sequentially applies the gate on voltage to the gate lines 120 to turn on the TFTs 110.

After the gray signal modifier 400 receives a data gray signal Gn from a data gray signal source (e.g. a graphic controller) (not shown), it generates a modified data signal Gn' based on a data gray signal of a current frame and a data gray signal of a previous frame. Here, the gray signal modifier 400 may either reside as a stand-alone unit, or be incorporated in a graphic card or an LCD module.

The data driver 300 changes the modified data gray signal Gn' received from the gray signal modifier 400 into corresponding gray voltages (data voltages) to be applied to respective data lines 130.

Next, referring to FIG. 2, the gray signal modifier 400 will be described in detail.

As shown in FIG. 2, the gray signal modifier 400 includes a synthesizer 410, a frame memory 420, a controller 430 and a gray signal converter and a separator 450.

The synthesizer 410 receives the gray signal Gn from the data gray signal source (not shown) to convert the frequency of a data stream such that the gray signal modifier 400 can process the gray signal Gn. For example, provided that 18-bit data are received from the data gray signal source in synchronization with the frequency of 65 MHz and a maximum processing frequency of a component of the data gray signal modifier 400 is 50 MHz, the synthesizer 410 synthesizes a 36-bit gray signal Gm by combining two 18-bit gray signals and transmits it to a frame memory 420.

The frame memory 420 reads and outputs the previous gray signal $G_{m-1}$ stored in a specific address to the gray signal converter 440, and simultaneously stores the gray signal Gm transmitted from the synthesizer 410 to the specific address. The gray signal converter 440 receives the gray signal Gm of the current frame outputted from the synthesizer 410 and the gray signal $G_{m-1}$ of the previous frame outputted from the frame memory 420, and thereafter, generates the modified gray signal Gm' based thereon.

The separator 450 divides the 36-bit modified data gray signal Gm' outputted from the gray signal converter 440 to output a 18-bit modified gray signal Gn'.

According to an embodiment of the present invention, since the clock frequency in synchronization with the data gray signal is different from accessing frequency to the frame memory, the synthesizer 410 and the separator 450 synthesizing and dividing the data gray signal are needed. However, when the clock frequency in synchronization with the data gray signal is the same as the accessing frequency to the frame memory, they are not needed.

Here, the frame memory 420, as shown in FIG. 3, is preferably to be implemented as a separate external memory. Examples of an external memory having a performance of the frame memory are burst-type memories such as SDRAM and DDR SDRAM. Although an embodiment of the present invention uses 64Mb SDRAM having a structure of 512K×32×4 banks as a frame memory, it will be apparent to those skilled in the art for using another burst-type memory.

The frame memory 420 as a 64Mb SDRAM having a structure of 512K×32×4 banks according to an embodiment of the present invention needs a total 52 pins in order to interface with the gray signal modifier 400. The 52 pins include four first group pins, sixteen second group pins and third group pins. The four first group pins include a clock ("CLS"), a clock enable ("CKE"), a chip select ("CS") and a data mask ("DQM"). The sixteen second group pins include a row access strobe ("RAS"), a column access strobe ("CAS"), a write enable ("WE"), two bank addresses ("BAO" and "BA1") and eleven addresses ("ADDRO"to "ADDR1O"). The third group pins include 32 data pins ("DQO" to "DQ31").

The size of the die of the gray signal modifier 400 formed as a chip is increased proportional to square of the number of the total pins, this in turn increases the production cost. Thus, if the number of pins of the gray signal modifier 400 is decreased, it is possible to decrease the die size, thereby decreasing the production cost. It is true for a stand-alone data gray signal modifier 400 as well as for a data gray signal modifier incorporated in a graphic card or an LCD module.

A frame memory and a driving method thereof will be described in detail according to an embodiment of the present invention with reference to FIGS. 4 and 5A to 5C.

Figure 4:
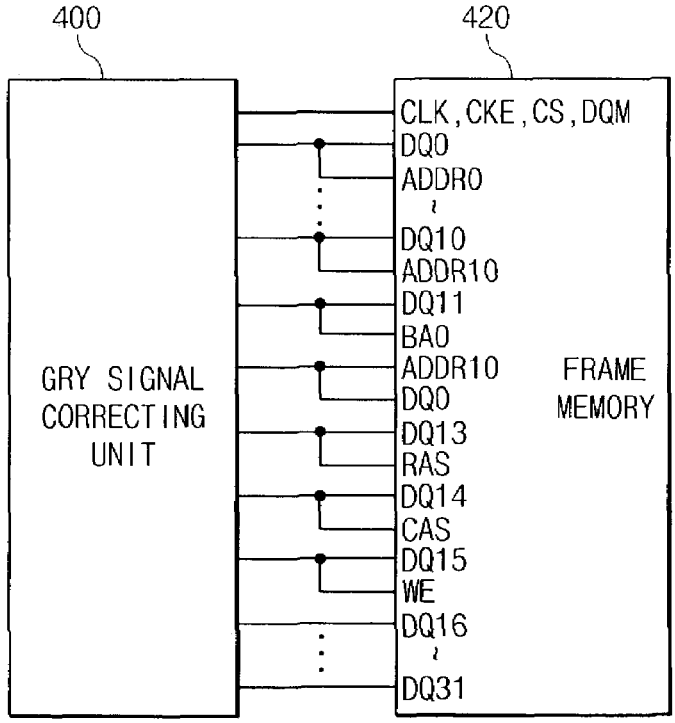
FIG. 4 is a block diagram illustrating an implementation of a frame memory as an external memory according to an embodiment of the present invention.

FIG. 4 is a block diagram illustrating implementation of a frame memory as an external memory according to an embodiment of the present invention.

As shown in FIG. 4, in case of using a 64 Mb SDRAM having a structure of 512K×32×4 banks as the frame memory 420, the number of pins of the gray signal modifier 400 is decreased by 16 because buses of the 16 second group pins and 16 pins of the third group pins are shared unlike FIG. 3.

Since the burst-type frame memory 420 has a burst mode, it can read and write data by at most one page without other separate instructions. This burst type frame memory 420 may share the second group pins and the third group pins by adjusting a control sequence for the second group pins and the third group pins as described below.

A driving method of the frame memory 420 according to the first embodiment of the present invention will be described in detail with reference to FIGS. 5A to 5C.

Figure 5A:
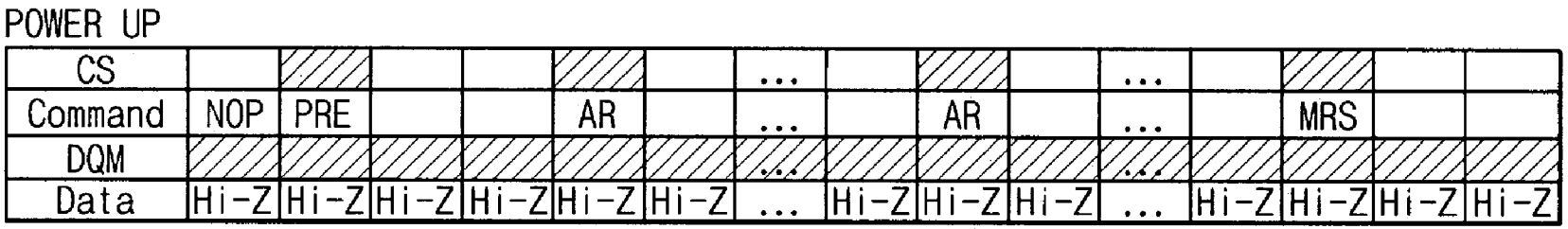
FIG. 5A is a sequence drawing illustrating power up of a frame memory.

FIG. 5A illustrates a sequence of power up of a frame memory, FIG. 5B illustrates a sequence of burst reading of a frame memory, and FIG. 5C illustrates a sequence of burst writing of a frame memory.

First, a power up step of a frame memory 420 will be described with reference to FIG. 5A.

A power up step is initially needed in order to perform a normal operation of the frame memory 420 such as reading or writing. The power up step is performed only by a command and thus requires no data input and output, thereby masking data pins by making a DQM active. In other words, data input and output is kept in an open state of high impedance ("HI-Z") state. This power up step includes a no operation ("NOP"), a precharge ("PRE"), an auto refresh ("AR") and a mode register set ("MRS").

In the NOP step, the CKE is made to be active and the CS, the RAS, the CAS and the WE pins are made to be inactive to be kept for 200 $\mu$s in the state of input of a stable clock. In the PRE step, the CS, the RAS and the WE pins are made to be active and the CAS pin inactive and ADDR10 is set to be "1", thereby precharging all the banks of the frame memory 420. In the AR step, the CS, the RAS and the CAS are made to be active and the WE is made to be inactive, refreshing the precharged memory. This AR step is repeated at least two times. In the MRS step, the CS, the RAS the CAS and the WE are made to be active and the BA0, the BA1, and the ADDR0 to the ADDR10 are made to take the value of MRS, thereby setting CAS latency LT (2 or 3), the length of burst (1, 2, 4, 8 or full pages) and a burst type.

After the power up step, it is possible to burst-read or burst-write the frame memory 420. The case of setting the length of burst to a full page in the MRS step of the power up step will be now described.

Referring to FIG. 5B, a method of burst-reading the frame memory 420 will be described.

First, banks to be read are addressed to the BA0 and the BA1, and then, the CS, the RAS and the WE are made to be inactive and the ADDR10 is set to 0 to precharge the banks manually addressed (PRE0). After precharging, rows storing data to be read are addressed to ADDR0 to ADDR10. Then, the CS and the RAS are made to be active and the CAS and the WE is made to be inactive to make the previously addressed row active ("RA0"). Since the PRE0 and the RA0 steps do not read valid data yet, the DQM is active.

Next, columns of first data to be read are addressed to ADDR0 to ADDR7, and then, the CS and the CAS are made to be active and the RAS and the WE inactive and the ADDR10 is set to 1 to instruct CAS ("RD0"). On instructing CAS, the DQM is made to be active so that the CAS instruction is inserted into the frame memory 420 well, and DQM is made to be inactive so that data is read ("RD0").

Here, when the CAS latency LT is set to 2, data is read after 2 clocks from the CAS instruction, yet, the DQM instruction operates after 2 clocks. That is, since the DQM is in the inactive state for 2 clocks from the CAS instruction, data is not read, and data can be read hereafter. Accordingly, when the ADDR0 to ADDR7 are set, data can be normally read by assigning the address to an address—1 of row of first data to be read. As shown in FIG. 5*b*, on reading Q1 first, the address is assigned to Q0. However, when the CAS latency LT is 3, the above problem do not happen, and thus, row of first data to be read is addressed to ADDR0 to ADDR7.

As above, the address of row assigning data of 256 cells is first burst-read one after another from the change of DQM into inactive. In this case, as shown in FIG. 4, the RAS, the CAS, the WE, the BA, the ADDR0 and ADDR10 may be changed in their states on reading data since data pins and the second group pin share the bus, however, when the CS not sharing the bus are kept inactive, the instruction is not inserted into the frame memory 420.

Since 1024 pixels are in one line in case of XGA display, only 256 cells in one column of one bank are not sufficient to store these pixels. Thus, after one column of one bank is read, the next bank must be read continually.

As in the PRE0 step, the next bank to be read is addressed to the BA0 and BA1 and is precharged during next clock of last valid data of the previous bank or thereafter (PRE1). In the meanwhile, as mentioned above, in the read state, since the DQM instruction operates after 2 clocks, the DQM is made to be active before 1 clock of last valid data to mask data from next clock of last valid data. Since operations of making the CAS instruction RA1 and the burst-read RD1 after precharge are the same as that of the RA0 and the RD0, the description will be omitted.

Data for display is inputted sequentially, and in contrast, data of next bank is read after data of one bank is read. This cause time differences. To compensate such time differences, a cache memory 415 may be disposed within the gray signal modifier 400. It is possible to compensate such time differences by temporarily storing the gray signal of the current frame transmitted to gray signal modifier 400 and by transmitting it to the frame memory 420.

When all the data in one line are read changing the banks, the DQM is made to be active before 1 clock of the last valid data of the last bank to mask data pins from next clock of valid data, and then, data of next line are read. Since the process of reading data of next line is the same as that described above, the description will be omitted.

Next, referring to FIG. 5*c*, a method of a burst-write into the frame memory 420 will be described.

The process of the burst-write is the same as that of the burst-read except having no CAS latency LT.

In detail, as in the PRE0 step of the burst-read, a bank to be written is precharged (PRE0), and then, a row to be written is made to be active (RA0). Since the DQM instruction works on the clock cycle in the write state without the latency LT, the DQM is kept active till the CAS instructs and the DQM is set to inactive from next clock (WR0). Since data is inputted from next clock of the CAS instruction, a row of data to be written is addressed to the ADDR0 to the ADDR7, and the assigned address is prior to the address to store data by 1 (or more than 1). In this way, data of 256 cells are written one by one from next clock of the CAS instruction.

Since 256 cells only are in one row of one bank in the burst-write too, data must be written in next bank continually. Since there is no latency LT unlike the burst-read on writing data in next bank, the DQM is made to be active from next clock of last valid data. Since the following operations (PRE1, RA1 and WR1) are practiced easily by those skilled in the art with reference to the drawings and the aforementioned description, the description thereof will be omitted.

When data in one line are all written changing the banks, the DQM is made to be active from next clock of last valid data of last bank to mask data from next clock of valid data, and thereafter, data in next line are written. Since this process is the same as that described above, the description will be omitted.

As above, data can be burst-read, burst-written, burst-written after burst-read, or burst-read after burst-written according to the first embodiment of the present invention.

Next, a method of driving a frame memory according to a second embodiment of the present invention will be described.

Whenever read or written, one bank was precharged in the method of driving the frame memory according to the first embodiment of the present invention, while all the banks are precharged on reading or writing data in one line in the second embodiment.

In detail, in the precharge step PRE0 of first bank before data in one line is read or written, CS, RAS and WE are made to be active and CAS inactive and ADDR10 is set to 1 to precharge all the banks. Thereafter, when next bank is read or written, the precharge step PRE1 is omitted, and the CAS only has to be instructed directly (RA1). Since another processes are similar to the first embodiment, the description will be omitted.

Next, a method of driving a frame memory according to a third embodiment of the present invention will be described.

Although the precharge was instructed manually in the method of driving the frame memory according to the first and the second embodiments of the present invention, the precharge is done automatically within the frame memory in the third embodiment.

In detail, if the ADDR10 is set to 1 on instructing the CAS (RA0 and RA1), the precharge is done automatically within the frame memory without a separate precharge instruction PRE1 on burst-reading or burst-writing next bank after completion of burst-reading or burst-writing one bank. Another processes are similar to the first and the second embodiments, and thus, the description will be omitted.

Although the present invention has been described with reference to the preferred embodiments, those skilled in the art will appreciate that the present invention will be variously modified and changed in the scope without departing from spirit and scope of the present invention described in the following claims.

As above, according to the present invention, the gray signal modifier can decrease the portion interfacing with the frame memory to decrease the size of the gray signal modifier.

What is claimed is:

1. A liquid crystal display comprising:

a liquid crystal display panel including a plurality of gate lines for transmitting scan signals, a plurality of data lines for transmitting data voltages, and a plurality of pixels having switching elements connected to the gate line and the data line;

a gate driver sequentially supplying the scan signal to the gate lines;

a gray signal modifier receiving a gray signal from a data gray signal source and generating and outputting a modified gray signal considering a gray signal of current frame and a gray signal of previous frame; and a data driver converting the modified gray signal outputted from the data gray signal source into a corresponding data voltage and supplying it to the data line, wherein the gray signal modifier includes a frame memory storing the gray signal of the current frame from the data gray signal source by a burst mode that processes a specific amount of data by once instruction, and outputting the gray signal of the previous frame by the burst mode, the frame memory is formed on the exterior of the gray signal modifier to interface with the gray signal modifier, and the frame memory comprises:

a plurality of data pins one to one connected with a plurality of buses interfacing with the gray signal modifier and inputting and outputting data;

a plurality of instruction pins sharing the buses with the data pins and receiving instructions needed to operate the frame memory;

a data masking pin used to mask the data pins when no data input and output; and a chip selecting pin used to select the buses as the data pins or the instruction pins.

2. The liquid crystal display of claim 1, wherein the gray signal modifier further comprises a controller controlling reading and writing the gray signal of the frame memory; and a gray signal converter generating and outputting the modified gray signal depending on the gray signal of the current frame and the gray signal of the previous frame.

3. The liquid crystal display of claim 2, the gray signal modifier further comprises a cache memory temporarily storing the gray signal of the current frame transmitted to the frame memory and transmitting it to the frame memory.

4. The liquid crystal display of claim 1, wherein the buses are used in the instruction pins when the data masking pins and the chip selecting pins are in the active state, and the buses are used in the data pins when the data masking pins and the chip selecting pins are in the inactive state.

5. The liquid crystal display of claim 4, wherein, in the frame memory, the buses are used in the instruction pins, so that banks of the frame memory are precharged and addresses of row storing data and column of first data to be read are assigned, and the buses are used in the data pins, so that data of the assigned row are read by the burst mode from the assigned column.

6. The liquid crystal display of claim 1, wherein, in the frame memory, the buses are used in the instruction pins, so that banks of the frame memory are precharged and addresses of row writing data and column of first data to be written are assigned, and the buses are used in the data pins, so that data of the assigned row are written by the burst mode from the assigned column.

7. A method of driving a liquid crystal display comprising a plurality of data pins one to one connected with a plurality of buses from the exterior and inputting and outputting data, a plurality of instruction pins sharing the buses with the data pins and receiving instructions needed to operate the frame memory, a data masking pin used to mask the data pins, and a chip selecting pin used to select chips, and a frame memory storing and outputting a gray signal by a burst mode during one frame, the method of driving liquid crystal display comprising:

burst reading a gray signal of previous frame by the burst mode using the buses as the data pins or the instruction pins by changing the state of the data masking pins and the chip selecting pins; and burst writing a gray signal of current frame by the burst mode using the buses as the data pins or the instruction pins by changing the state of the data masking pins and the chip selecting pins.

8. The method of driving the liquid crystal display of claim 7, wherein the burst reading comprises:

precharging banks of the frame memory by selecting the buses as the instruction pins;

assigning row storing a gray signal to be read;

assigning an address of first column to be read in the assigned row; and changing the buses into the data pins to read a gray signal stored in the assigned column by the burst mode from the assigned column one by one.

9. The method of driving the liquid crystal display of claim 7, wherein the burst writing comprises:

precharging banks of the frame memory by selecting the buses as the instruction pins;

assigning row storing a gray signal to be read;

assigning an address of first column to be read in the assigned row; and changing the buses into the data pins to write a gray signal in the assigned row by the burst mode from the assigned row one by one.

10. The method of driving the liquid crystal display of claim 9, precharging only banks having the assigned row out of the banks of the frame memory.

11. The method of driving the liquid crystal display of claim 9, precharging all the banks of the frame memory simultaneously.

12. The method of driving the liquid crystal display of claim 9, wherein the assigning the address of first row comprises providing an auto-precharge instruction so that next bank is precharged within the frame memory by itself.

13. The method of the driving the liquid crystal display of claim 9, wherein the burst writing comprises writing the gray signal of the current frame in the frame memory after temporarily storing it in an external cache memory.

* * * * *